US007623086B2

(12) United States Patent
Lafleur

(10) Patent No.: US 7,623,086 B2
(45) Date of Patent: Nov. 24, 2009

(54) WIRELESS COMMUNICATION SYSTEMS AND METHODS AND TRANSMITTER UNITS FOR USE THEREIN

(75) Inventor: Philippe Jonathan Gabriel Lafleur, Ottawa (CA)

(73) Assignee: Resonance Microwave Systems Inc., Ottawa (CA)

( * ) Notice: Subject to any disclaimer, the term of this patent is extended or adjusted under 35 U.S.C. 154(b) by 10 days.

(21) Appl. No.: 12/003,471

(22) Filed: Dec. 26, 2007

(65) Prior Publication Data

US 2008/0186246 A1 Aug. 7, 2008

Related U.S. Application Data

(60) Provisional application No. 60/898,703, filed on Feb. 1, 2007, provisional application No. 60/960,294, filed on Sep. 24, 2007.

(51) Int. Cl.
*H01Q 1/52* (2006.01)

(52) U.S. Cl. ..... 343/841; 455/106

(58) Field of Classification Search ..... 343/841, 343/702, 846, 900, 906, 700 MS; 455/91, 455/106, 129

See application file for complete search history.

(56) References Cited

U.S. PATENT DOCUMENTS 7,099,631 B2 * 8/2006 Lee et al. ..... 455/90.1
2006/0132360 A1 * 6/2006 Caimi et al. ..... 343/700 MS

* cited by examiner

*Primary Examiner*—Daniel D Chang
(74) *Attorney, Agent, or Firm*—Thomas Adams

(57) ABSTRACT

A wireless communication system includes a portable, typically hand-held transmitter which includes RF absorbing material and/or one or more dissipative parasitic antennas for reducing RF fields in close proximity to the operator to such an extent as to substantially preempt the effect of the operator presence, specifically the operator's hand, in field operation. As a result, the RF absorbing material and/or one or more dissipative parasitic antennas reduces the proportionate effect upon the RF radiation level caused by the operator's hand or other body part. The RF absorbing material may comprise a layer of such material upon a surface of a ground plane within a housing of the transmitter, and/or on an interior surface of the housing, and/or on an exterior surface of the housing. The dissipative parasitic antenna may comprise a printed antenna and resistive load integrated on the transmitter's printed circuit board or elsewhere in or on the housing.

14 Claims, 6 Drawing Sheets

Front

Front

Back

Front

WIRELESS COMMUNICATION SYSTEMS AND METHODS AND TRANSMITTER UNITS FOR USE THEREIN

CROSS-REFERENCE TO RELATED APPLICATIONS

This application is related to U.S. Provisional patent application No. 60/898,703 filed Feb. 1, 2007 and U.S. Provisional patent application No. 60/960,294 filed Sep. 24, 2007. The entire contents of each of these Provisional patent application are incorporated herein by reference.

BACKGROUND OF THE INVENTION

1. Technical Field

This invention relates to wireless communications systems and methods and wireless transmitter units for use therein and is especially concerned with radiated power and hence range of such wireless transmitter units in field operation.

2. Background Art

Radio frequency (RF) transmitters for control/communications/signaling systems are used in a wide variety of applications. In some applications, the transmitter is a hand-held, standalone unit, i.e., not part of a transceiver. One particular application is the monitoring of persons, such as hydro workers, forestry workers, oilfield workers, and so on, who work alone in remote or isolated locations outside of their vehicle. It is known for such workers to use a hand-held transmitter to communicate periodically with a receiver in the worker's vehicle, for example, to convey status or other signaling messages. The receiver in the vehicle is associated with a satellite transceiver whereby the status or signaling messages, along with position information, can be communicated to a central location or monitoring station via a satellite communications network.

It is generally desirable to have a longer operating range allowing the user to be farther from the receiver (vehicle) and still be able to use the transmitter to send an "OK" or "PANIC" signal back to the receiver. For systems employing unlicensed bands in the vicinity of 400 MHz, typical ranges achieved for safety systems vary from hundreds to thousands of feet.

Regulatory bodies, such as the FCC in the United States of America, have certain frequency bands allocated for unlicensed operation. These bands are popular choices for remote signaling systems because of the cost savings associated with unlicensed operation. To avoid spectral interference between systems, the regulations prescribe limits to RF radiation levels. In order to maximize range, RF radiation levels of the transmitters are set just below regulatory limits.

Since transmitted power cannot be increased beyond the prescribed limit, other approaches have been used to increase range. One approach is to increase receiver antenna gain. For vehicular applications requiring 360 degree azimuthal coverage, however, practical increases in receive antenna gain are limited.

Inadequate range may also result from the manner in which a particular transmitter is tested to determine compliance with the prescribed limit. More particularly, it is usual to operate the transmitter in a suitable chamber and measure its output using a field strength meter. In field operation, however, RF radiation levels are reduced by the presence of the operator's hand near the antenna. The hand absorbs RF radiation and potentially detunes the transmitter's antenna, thereby reducing the RF radiation level available at the receive antenna.

This effect might be mitigated to some extent by keeping the operator's hand as far away as possible from the antenna. For example, increasing the size of the transmitter housing, or providing a separate antenna, causes the controls and handgrip to be further away from the antenna. This approach would be undesirable, however, where a compact transmitter is required, as is usually the case.

Another approach might be to discourage handheld operation, by providing a wrist band, but this would be impractical or undesirable for most applications and, because the wrist would still be in close proximity to the antenna, performance would still be negatively affected.

To summarize, maximum radiation levels are limited by the regulations, which determine the maximum allowable RF radiation level for the transmitter in isolation. In field operation, the actual maximum radiation level is reduced by the proximity of the operator.

SUMMARY OF INVENTION

An object of the present invention is to mitigate the deficiencies of known such wireless communications systems, and transmitters, or at least provide an alternative.

According to one aspect of the present invention, there is provided portable radio frequency (RF) transmitter means (500,600) for use in a wireless communications system to transmit RF signals at a frequency for which maximum transmitted radiation level is restricted by regulation, the portable radio frequency (RF) transmitter means (500,600) having an antenna means (203) for radiating RF energy at said frequency and an absorber means (501,601,602) for reducing radiation efficiency of the antenna means (203) in all directions when in isolation such that, when the transmitter means is being carried and used by an operator, the relative effect upon the output radiation of the antenna means (203) attributable to the presence of the operator is reduced.

According to a second aspect of the invention, there is provided a method of compensating for deleterious effects of operator presence upon radiation level of a portable radio frequency (RF) transmitter means of a wireless communications system, the transmitter means having an antenna means and an absorber means, maximum radiation level of the transmitter means in any direction being restricted by regulations, the method including the steps of calibrating said maximum radiation level of the transmitter means with said absorber means reducing radiation efficiency of the antenna means (203) in all directions, the absorber means remaining in or on the transmitter means during normal operation such that when the transmitter is being carried and used by an operator, the relative effect upon the output radiation of the antenna means (203) attributable tote presence of the operator is reduced.

Embodiments of the invention will now be described by way of example only and with reference to the accompanying drawings.

BRIEF DESCRIPTION OF DRAWINGS

In the drawings, identical or corresponding elements in the different Figures have the same reference numeral.

DESCRIPTION OF PREFERRED EMBODIMENTS

Figure 1:
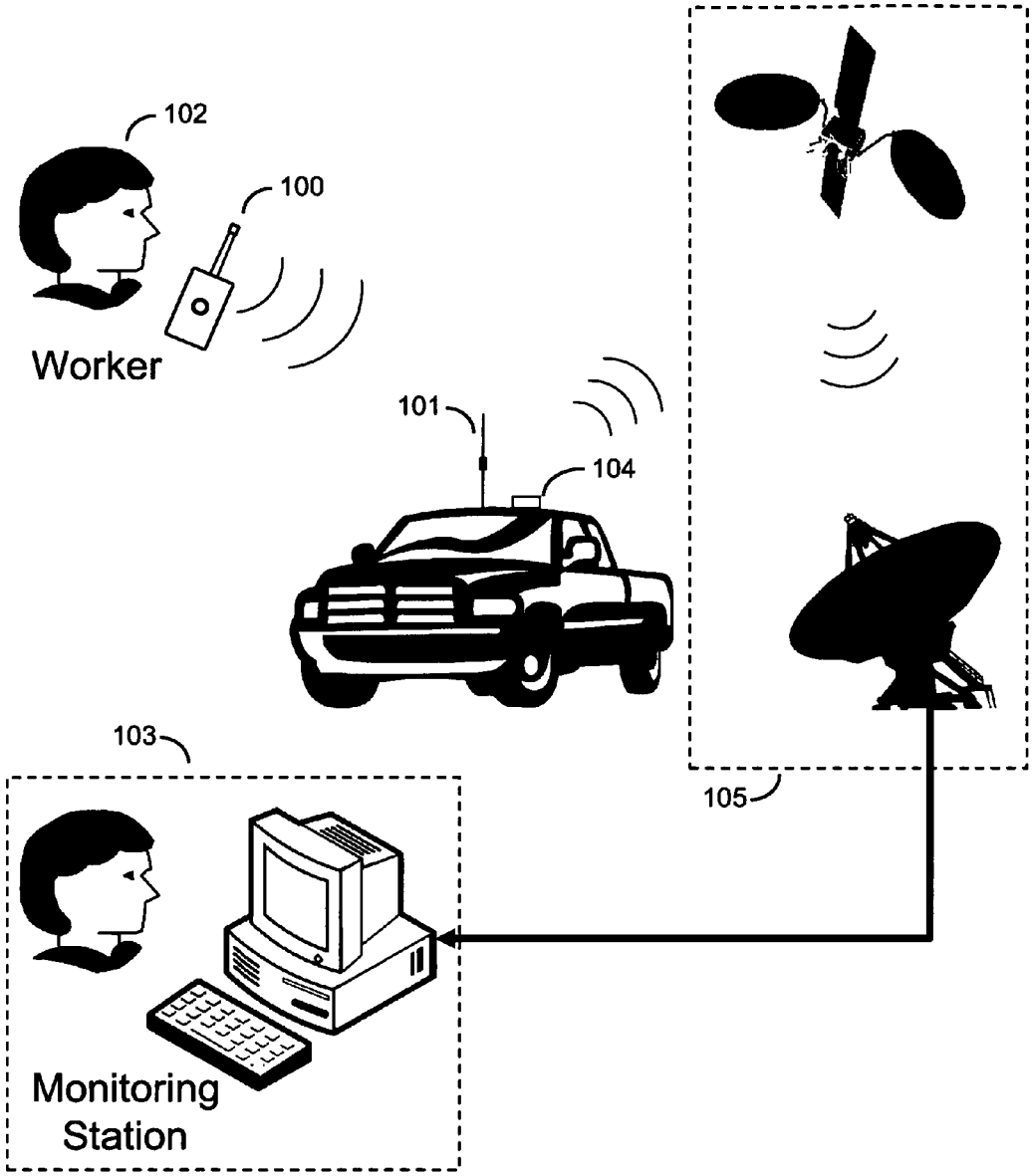
Fig 1 Prior Art
FIG. 1, labelled PRIOR ART, illustrates components of a typical unidirectional wireless signaling/communications system.

FIG. 1 illustrates a known kind of unidirectional wireless signaling/communications system with a portable, specifically hand-held, transmitter unit 100 and a vehicle-based receiver 101 for a safety application, specifically for use by a person 102 carrying the transmitter unit 100 while working in an isolated location to transmit status signals periodically to the receiver 101, which relays reports, including status signals of interest and position information, to a monitoring station 103 via a satellite transceiver 104 and a satellite communications network 105.

Figure 2:
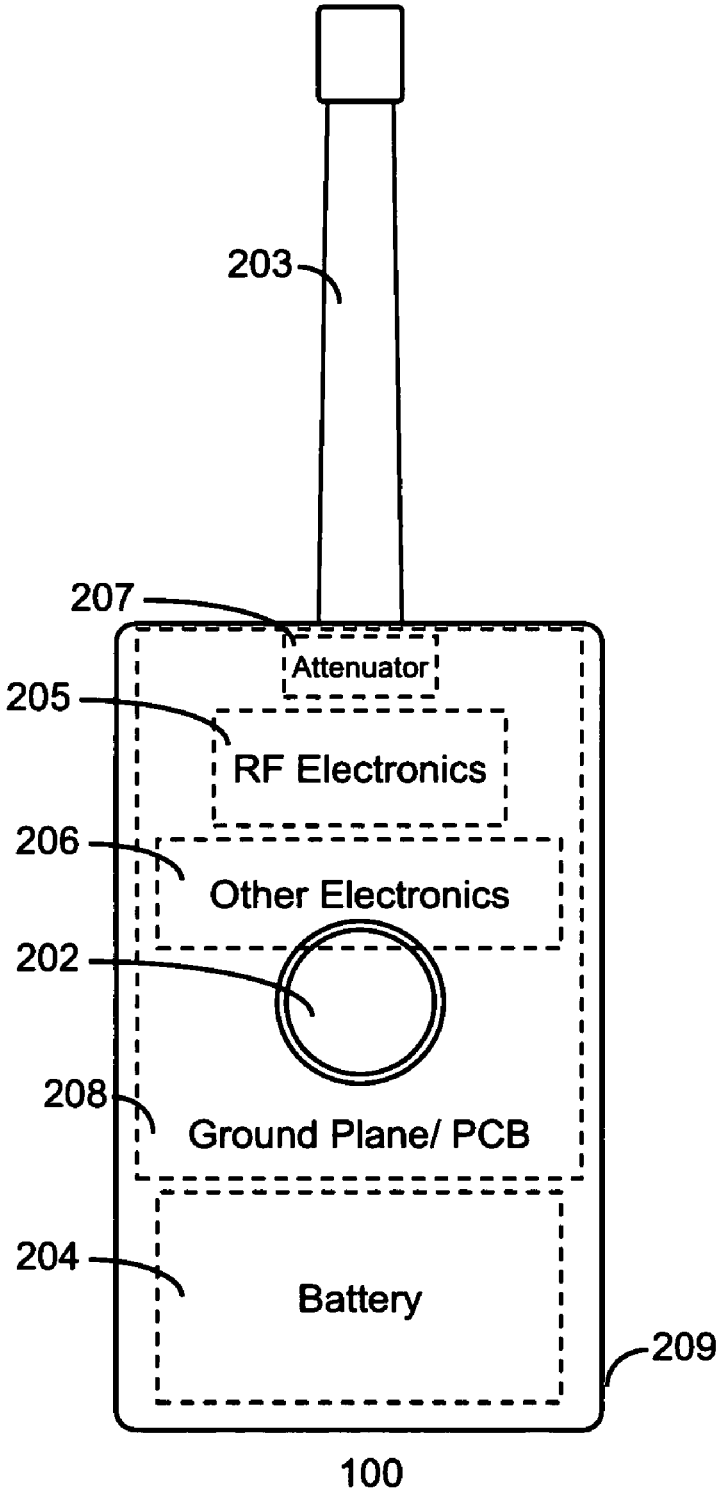
Fig 2 Prior Art
FIG. 2, labelled PRIOR ART, illustrates a known transmitter unit of the kind used in the system of FIG. 1.

As shown in FIG. 2, the transmitter unit 100 includes operator controls 202, a monopole antenna 203, a battery 204, and the usual electronics, which include RF electronics 205 and other electronics 206, and an attenuator 207, all located on a printed circuit board (PCB) 208 which also acts as a ground plane for the monopole 203. This attenuator 207 can be used to adjust the radiation level as required, typically from 0-20 dB. It should be noted that in a monopole configuration, the transmitter unit's antenna actually comprises the monopole antenna 203 and its ground plane 208. All of these components 202-208 are located in or on the housing 209.

The operator controls 202 would typically include "PANIC" and "OK" buttons. Operation of the "PANIC" button by the operator causes an emergency signal to be transmitted to the receiver and relayed immediately to the monitoring station. The operator is required to operate the "OK" periodically to cause the transmitter unit to send a "Status OK" signal to the monitoring station, to confirm that he is "OK". The absence of an "OK" signal after a predetermined amount of time triggers a "NOT OK" report, generated at the receiver 101, to be sent to the monitoring station. In either case, the personnel at the monitoring station would then send help to the operator, determining his location from position information embedded in the "PANIC" or "NOT OK" report.

Because the system is unidirectional, the only range-affecting performance metric for the transmitter unit 100 is its radiation level, the maximum radiation being limited by applicable regulations. RF radiation levels are determined by a combination of the antenna (203, 208) performance and the output power of the RF electronics 205, for a given setting of the attenuator 207. Thus, degraded performance of the transmitter antenna (203, 208) can be compensated for by increasing the output power of the RF electronics 205 to maintain the same RF radiation levels. This is to be contrasted with a receiver where the receive sensitivity is directly affected by the receiver's antenna and cannot be compensated for by other means to maintain the same level of performance.

Figure 3:
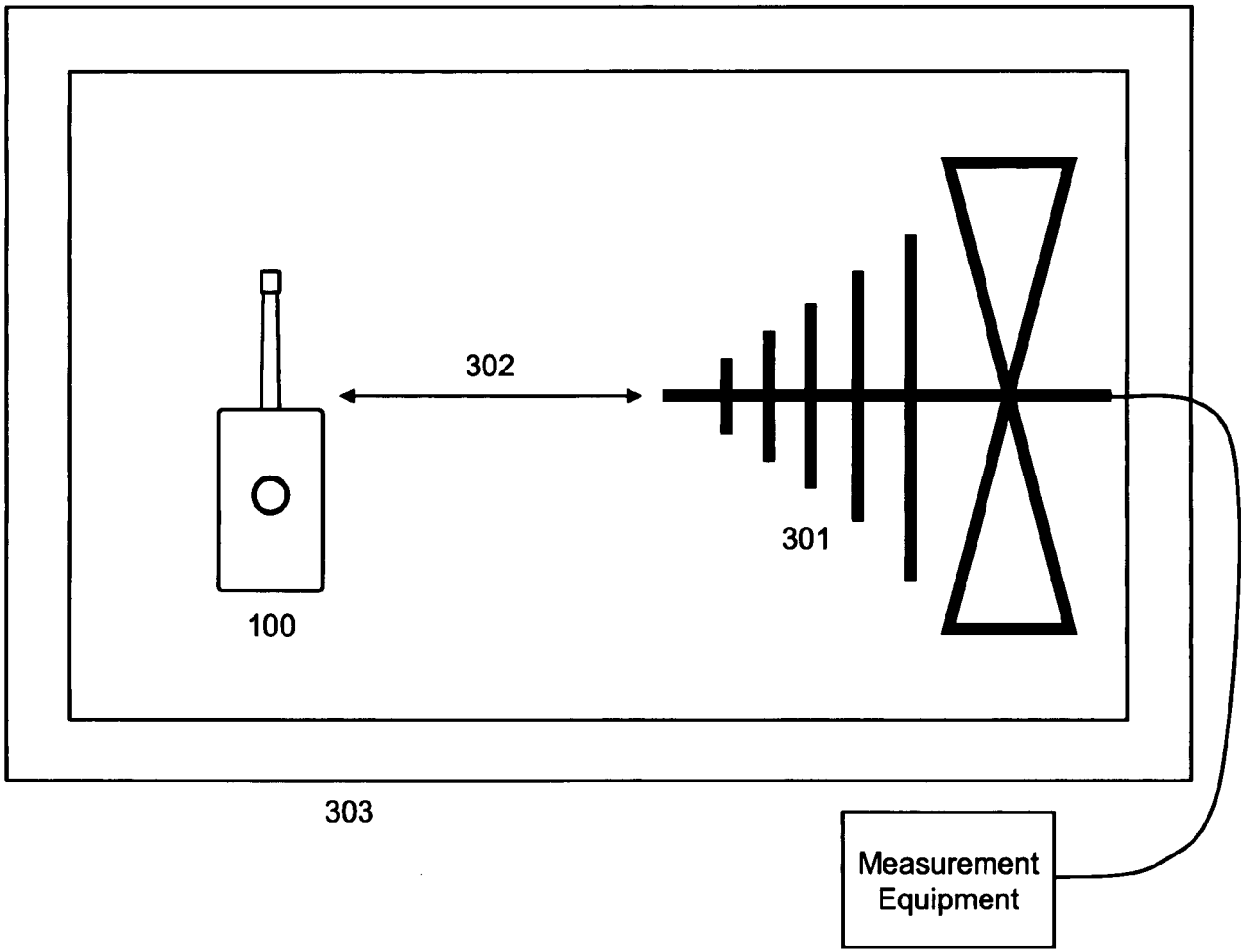
Fig 3 Prior Art
FIG. 3, labelled PRIOR ART, illustrates the transmitter unit and its surroundings during regulatory testing.

As discussed hereinbefore, the RF radiation levels from the transmitter 100 are limited by applicable regulations and established by measurements conducted upon a sample transmitter unit 100 in isolation. A typical configuration for regulatory compliance measurements is illustrated in FIG. 3. The transmitter 100 is supported by a non-invasive support and transmits without an operator in close proximity, while a neighbouring calibrated test receiver 300 with a receive antenna 301 measures the radiation levels at a prescribed distance 302. The test environment 303 is shielded and anechoic to create conditions that approximate free-space operation.

This calibrated test setup is used to set the maximum RF radiation level of the transmitter 100, specifically by adjusting the attenuator 207 while monitoring the radiation level measured by the receiver. It should be noted that this is done without an operator's hand in the near field and in close proximity to the antenna or ground plane.

Figure 4:
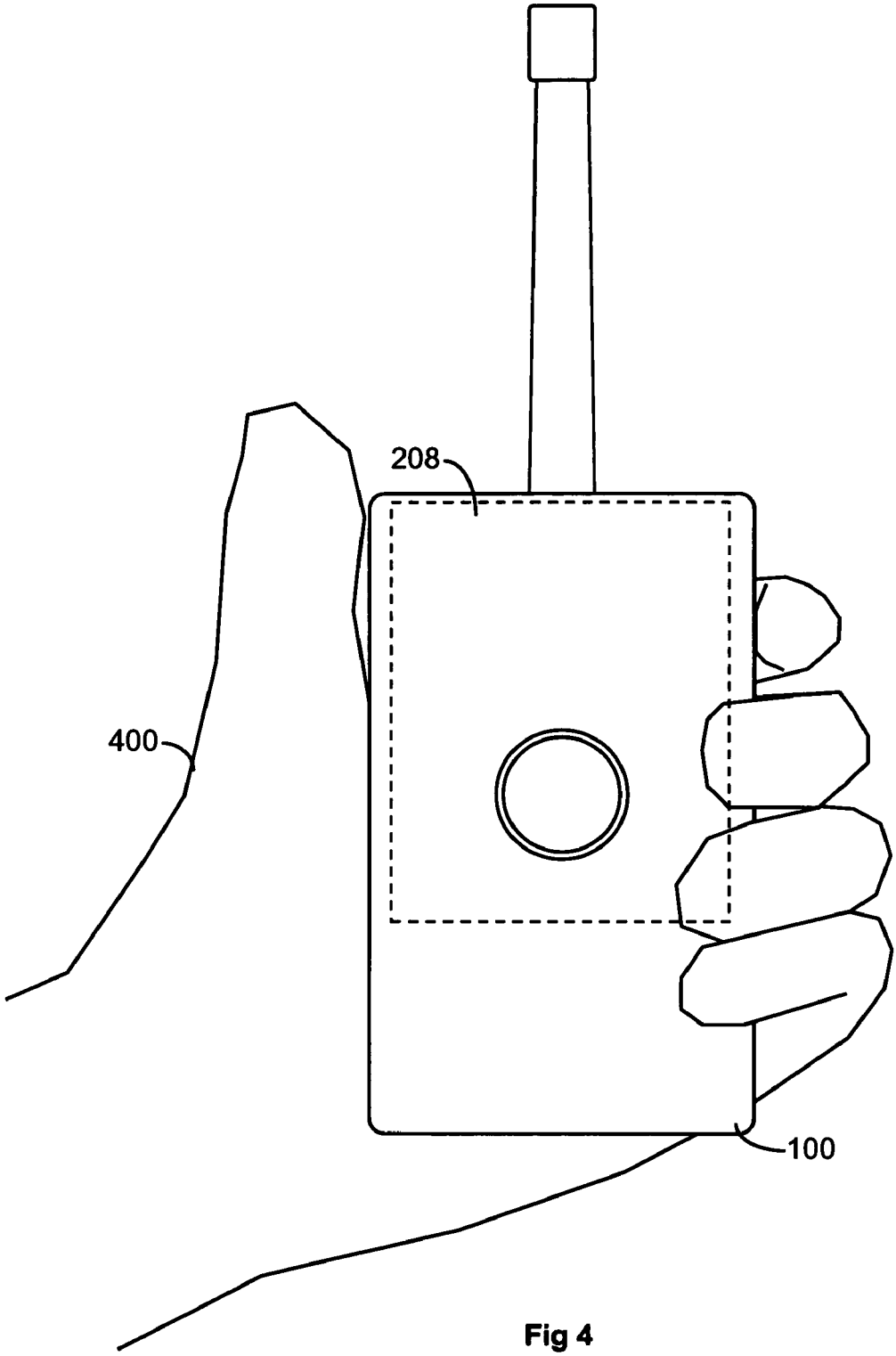
Fig 4 Prior Art
FIG. 4, labelled PRIOR ART, illustrates the transmitter unit with an operator's hand present in field operation.

FIG. 4 shows the transmitter 100 in use, i.e., in the hand 400 of an operator. The operator's hand 400 is wrapped around the transmitter 100, but more particularly, wrapped around the ground plane 208, causing a reduction in the radiation level of the transmitter unit 100. Because the operator's hand was not present during regulatory compliance testing, no allowance was made for the resulting reduction in RF radiation level.

Thus, when the transmitter unit 100 is held in the operator's hand and actually being used in the field, the maximum radiation level attainable will be significantly lower than the maximum radiation level prescribed by the regulations as established during the above-described calibration process.

Figures 5A, 5B:
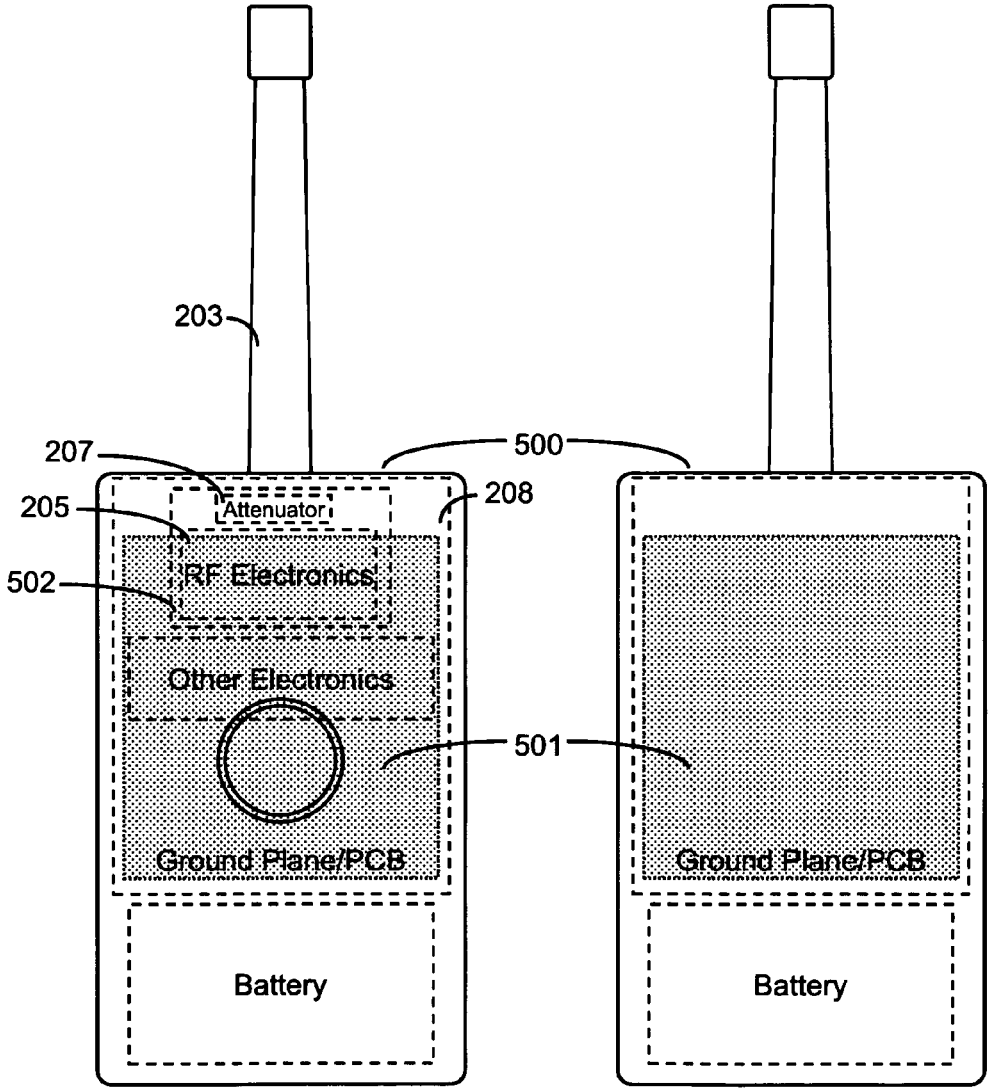
FIGS. 5A and 5B are front and rear views, respectively, of a first preferred embodiment of the present invention in the form of a transmitter unit including preemptive absorption.

A first preferred embodiment of the invention, which addresses this problem, will now be described with reference to FIGS. 5A and 5B. The transmitter 500 illustrated in FIGS. 5A and 5B is similar to that illustrated in FIG. 2 so components common to both have the same reference numbers. The transmitter 500 differs from the transmitter 100 of FIG. 2, however, in that it includes RF absorbing material 501 placed on the ground plane 208 below the monopole 203, in areas where the operator's hand 400 would be in close proximity. The RF absorbing material 501 is therefore present during regulatory testing.

Figure 6:
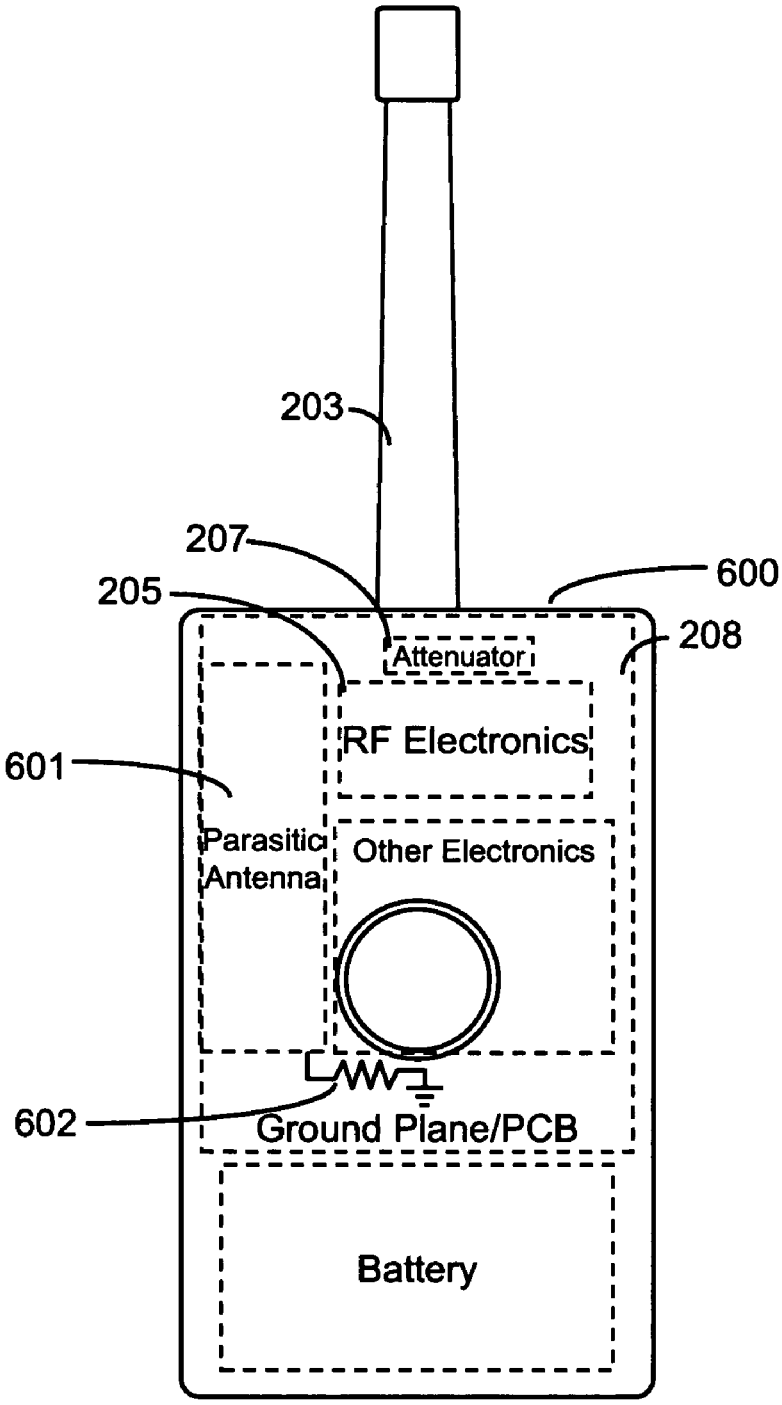
FIG. 6 is a front view, of a second preferred embodiment of the present invention in the form of a transmitter unit including preemptive absorption.

A second preferred embodiment of the invention, which also addresses this problem, will now be described with reference to FIG. 6. The transmitter 600 differs from the transmitter 100 of FIG. 2, however, in that it includes a parasitic antenna 601 integrated on the printed circuit board 208, in areas which would be proximate the operator's hand 400 when the transmitter was in use. Power received by the parasitic antenna 601 is then dissipated in a resistive load 602. Together, the parasitic antenna 601 and resistive load 602 form a dissipative parasitic antenna. The dissipative parasitic antenna 601,602 is therefore present during regulatory testing.

The way in which this substantially preempts the effect of the operator's hand 400 can be interpreted in two ways. In one interpretation, the RF absorbing material 501 or the dissipative parasitic antenna 601,602 can be seen to simulate the presence of the hand 400, thereby effectively including part of the hand when the RF radiation level is set as part of regulatory testing. In a second interpretation, the RF absorbing material 501 or the dissipative parasitic antenna 601,602 limits the RF fields in close proximity to the operator's hand 400, thereby reducing the hand's 400 effect. Both interpretations are valid and correct.

Referring also to FIG. 3, during regulatory compliance testing of the transmitter 500,600, the attenuator 207, between the RF electronics 205 and monopole 203, will be adjusted (reduced as compared with a typical known transmitter 100), so as to increase RF radiation levels to a maximum, within the regulatory limits, while compensating for the presence of the RF absorbing material 501 or the parasitic antenna 601 with resistive load 602. Then, in field operation, the effect of the operator's hand 400 is substantially preempted, with higher RF radiation levels and therefore longer range than would have been available without the use of RF absorbing material 501 or the dissipative parasitic antenna 601, 602.

Selection of either the RF absorbing material 501 approach or the dissipative parasitic antenna 601,602 approach, or both approaches in combination, depends on a number of factors including cost, space available, the configuration of the transmitter's communications antenna 203, the frequency of operation, absorber effectiveness at the frequency of operation and the likely operator hand 400 positions. The effectiveness and optimal configuration are best determined experimentally.

It should be noted that the selection and placement of the absorbing material are configuration dependent. Placement locations could include not only the ground plane 208 of the antenna, but the inside surface of the housing, or the outside surface of the housing, or the volume between the ground plane and the inside of the housing, or any combination of these locations.

Absorbing material characteristics must be carefully considered when determining placement. For example, for direct application to the ground plane 208, magnetically-loaded elastomeric absorber sheets, such as Wave-X-A020, from ARC technologies, have high losses in some of the frequency bands of interest and are effective because of inductive coupling. This has the effect of attenuating RF currents in the areas where the absorber material is applied. Wave-X-is also sufficiently non-conductive as to not affect the low-frequency performance of components and traces, thereby allowing direct application to a populated PCB/ground plane 208.

Internal parasitic antenna 601 and resistive load 602 selection and placement are configuration dependent. Parasitic antenna topologies could include, monopoles, dipoles, patch antennas, grounded line (example: planar inverted-f antenna, PIFA) antennas, or chip antennas. Resistive load configurations could include chip resistors, printed resistors, or a lossy transmission line. It is further envisaged that the parasitic antenna and load could combined in the form of a lossy antenna. Placement locations could include not only the PCB 208, but the inside surface of the housing, or the outside surface of the housing, or the volume between the ground plane and the inside of the housing, or any combination of these locations. The use of multiple dissipative parasitic antennas could be advantageous in configurations where one dissipative parasitic antenna cannot approximate the effect of the hand.

In the first preferred embodiment, the RF absorbing material 501 is used to cover all portions of the ground plane 208 (front and back) other than the portion of the ground plane in the closest proximity to the antenna. The RF electronics 205 are placed inside a shielded compartment 502 to avoid being covered with RF absorbing material 501 which could affect their performance.

In the second preferred embodiment, the parasitic antenna 601, is located in close proximity to the likely hand 400 position and is integrated in the PCB 208. The resistive load 601, is a chip resistor, mounted on the PCB 208.

In certain applications, a combination of RF absorbing material (501) applied to one or more areas, and one or more dissipative parasitic antennas (601,602) might be advantageous. The effectiveness and optimal configuration are best determined experimentally.

It should be noted that, although the preferred embodiment described herein is concerned with increasing radiated power in field operation for a safety application, especially where operators working in isolation, especially in remote locations that are generally inaccessible to road vehicles, the present invention comprehends a number of alternative RF remote control/signaling applications including remote keyless entry, door and gate openers, among others. It is also envisaged that the system could be used by lone mountaineers to report their status to a receiver located at a stage or base camp.

Although embodiments of the invention have been described and illustrated in detail, it is to be clearly understood that the same are by way of illustration and example only and not to be taken by way of limitation, the scope of the present invention being limited only by the appended claims.

The invention claimed is:

1. Portable radio frequency (RF) transmitter means (500, 600) for use in a wireless communications system to transmit RF signals at a frequency for which maximum transmitted radiation level is restricted by regulation, the portable radio frequency (RF) transmitter means (500,600) having an antenna means (203) for radiating RF energy at said frequency and an absorber means (501,601,602) for reducing radiation efficiency of the antenna means (203) in all directions when in isolation such that, when the transmitter means is being carried and used by an operator, the relative effect upon the output radiation of the antenna means (203) attributable to the presence of the operator is reduced, wherein the absorber means covers a surface area of at least one side of the ground plane but leaves uncovered a portion of the ground plane adjacent an antenna (203) of the transmitter means.

2. Portable radio frequency (RF) transmitter means (500, 600) for use in a wireless communications system to transmit RF signals at a frequency for which maximum transmitted radiation level is restricted by regulation, the portable radio frequency (RF) transmitter means (500,600) having an antenna means (203) for radiating RF energy at said frequency and an absorber means (501,601,602) for reducing radiation efficiency of the antenna means (203) in all directions when in isolation such that, when the transmitter means is being carried and used by an operator, the relative effect upon the output radiation of the antenna means (203) attributable to the presence of the operator is reduced.

3. Portable radio frequency (RF) transmitter means according to claim 2, wherein the absorber means comprises a layer of RF absorbing material upon a surface of a ground plane (208) of the transmitter means, or an interior surface of a housing (209) of the transmitter means, or an exterior surface of a housing (209) of the transmitter means.

4. Portable radio frequency (RF) transmitter means according to claim 2, having a ground plane (208) within a housing (209) and wherein the absorber means occupies a volume between the ground plane (208) and an interior surface of the housing (209).

5. Portable radio frequency (RF) transmitter means according to claim 2, wherein the absorber means comprises a dissipative parasitic antenna means (601, 602) inside the housing (209) of the transmitter means, or on the exterior surface of the housing (209) of the transmitter means, or both inside and outside the housing of the transmitter means.

6. Portable radio frequency (RF) transmitter means according to claim 5, wherein the dissipative parasitic antenna means comprises one or more dissipative parasitic antennas.

7. Portable radio frequency (RF) transmitter means according to claim 6, wherein the dissipative parasitic antenna means comprises one or more antennas integrated within the printed circuit board (208) with chip resistors mounted on the printed circuit board (208).

8. Portable radio frequency (RF) transmitter means according to claim 2, wherein the absorber means comprises a combination of RF absorbing material means and one or more dissipative parasitic antenna means.

9. Portable radio frequency (RF) transmitter means according to claim 2, wherein the receiver means (104) is operable to communicate with a remote base station by wireless.

10. Portable radio frequency (RF) transmitter means according to claim 2, wherein the transmitter means comprises RF electronics components contained in a compartment such that there is no contact between the absorber means and the RF electronics components.

11. Portable radio frequency (RF) transmitter means according to claim 2, wherein the absorbing material comprises a non-conductive magnetically-loaded material.

12. Portable radio frequency (RF) transmitter means according to claim 2, further comprising control means for causing the transmitter means to transmit a signal if a predetermined time period has elapsed without operator input.

13. Portable radio frequency (RF) transmitter means according to claim 2, comprising a satellite transmitter for communicating with a remote base station of a satellite communications system.

14. A method of compensating for deleterious effects of operator presence upon radiation level of a portable radio frequency (RF) transmitter means of a wireless communications system, the transmitter means having an antenna means and an absorber means, maximum radiation level of the transmitter means in any direction being restricted by regulations, the method including the steps of calibrating said maximum radiation level of the transmitter means with said absorber means reducing radiation efficiency of the antenna means (203) in all directions, the absorber means remaining in or on the transmitter means during normal operation such that when the transmitter is being carried and used by an operator, the relative effect upon the output radiation of the antenna means (203) attributable to the presence of the operator is reduced.

* * * * *